US011180954B2

(12) United States Patent
Jang

(10) Patent No.: US 11,180,954 B2
(45) Date of Patent: Nov. 23, 2021

(54) CORDLESS BLIND APPARATUS

(71) Applicant: WINTEC KOREA INC., Gwangju-si (KR)

(72) Inventor: Seong-ryong Jang, Seoul (KR)

(73) Assignee: WINTEC KOREA, INC., Gwangju-si (KR)

( * ) Notice: Subject to any disclaimer, the term of this patent is extended or adjusted under 35 U.S.C. 154(b) by 170 days.

(21) Appl. No.: 16/462,670

(22) PCT Filed: Aug. 31, 2017

(86) PCT No.: PCT/KR2017/009577
§ 371 (c)(1),
(2) Date: May 21, 2019

(87) PCT Pub. No.: WO2018/093023
PCT Pub. Date: May 24, 2018

(65) Prior Publication Data

US 2020/0109600 A1 Apr. 9, 2020

(30) Foreign Application Priority Data

Nov. 21, 2016 (KR) ..... 10-2016-0155093

(51) Int. Cl.
*E06B 9/44* (2006.01)
*E06B 9/68* (2006.01)

(52) U.S. Cl.
CPC . *E06B 9/44* (2013.01); *E06B 9/68* (2013.01)

(58) Field of Classification Search
CPC ..... E06B 9/44; E06B 9/68; E06B 9/80; E06B 9/42; E06B 9/322; E06B 9/60; E06B 9/62; E06B 9/90; E06B 9/807; E06B 2009/6881; E06B 2009/2423; E06B 2009/2435; E06B 2009/2447; E06B 2009/2458; E06B 2009/405
See application file for complete search history.

(56) References Cited

U.S. PATENT DOCUMENTS 6,467,714 B1 * 10/2002 Rasmussen ..... E06B 9/44 242/381
8,820,386 B2 * 9/2014 Mullet ..... E06B 9/40 160/241

(Continued)

FOREIGN PATENT DOCUMENTS

CN 202850833 U 4/2013
CN 104080374 A 10/2014

(Continued)

*Primary Examiner* — Daniel P Cahn
*Assistant Examiner* — Matthew R. Shepherd
(74) *Attorney, Agent, or Firm* — Novick, Kim & Lee, PLLC; Jae Youn Kim

(57) ABSTRACT

The present invention provides a cordless blind apparatus that can be conveniently operated without a cord. The cordless blind apparatus includes: a roller that is fitted on a rotary shaft; a screen that is wound or unwound on the roller; a weight that is connected to the lower end of the screen and applies torque in a first direction in which the screen is unwound from the roller by the gravity; an elastic member that applies torque in a second direction in which the screen is wound, by applying elastic force to the roller; and a friction stopper assembly that generates friction force on the roller.

11 Claims, 13 Drawing Sheets

(56) References Cited

U.S. PATENT DOCUMENTS

| | | | | |
|---|---|---|---|---|
| 10,655,388 | B2 * | 5/2020 | Smith | E06B 9/32 |
| 2006/0162876 | A1 * | 7/2006 | Kwak | E06B 9/44 160/296 |
| 2014/0048217 | A1 | 2/2014 | Hsu et al. | |
| 2014/0216666 | A1 * | 8/2014 | Smith | E06B 9/90 160/84.04 |
| 2014/0374036 | A1 * | 12/2014 | Chen | E06B 9/90 160/313 |
| 2015/0047795 | A1 * | 2/2015 | Bohlen | E06B 9/42 160/316 |
| 2015/0191973 | A1 * | 7/2015 | Bohlen | E06B 9/78 160/291 |
| 2015/0368966 | A1 * | 12/2015 | Faller | E06B 9/34 160/311 |
| 2015/0376941 | A1 * | 12/2015 | Fujita | E06B 9/60 160/241 |

FOREIGN PATENT DOCUMENTS

| | | | |
|---|---|---|---|
| CN | 109983197 | A | 7/2019 |
| JP | 2011-038340 | A | 2/2011 |
| KR | 20-1993-0002730 | Y1 | 5/1993 |
| KR | 930002730 | Y1 | 5/1993 |
| KR | 20-0469335 | Y1 | 10/2013 |
| KR | 10-2014-0065430 | A | 5/2014 |
| KR | 10-1492020 | B1 | 2/2015 |
| KR | 20-0480955 | Y1 | 7/2016 |

* cited by examiner

CORDLESS BLIND APPARATUS

TECHNICAL FIELD

The present invention relates to a blind apparatus and, more particularly to a cordless blind apparatus that can be conveniently operated without a cord.

BACKGROUND ART

Blind apparatuses are installed to block direct sunlight passing through a window or gaze from the outside. It is possible to make a more comfortable indoor mood from soft glow effect by appropriately adjusting the amount of light using a blind apparatus. A blind apparatuses is installed over a window and has a structure that can cover/uncover the window.

A blind apparatus may include a screen that is rolled and unrolled. It is possible to open a portion or the entire of a window and adjust the amount of light by adjusting the size of the screen. In such a roll type blind apparatus, it is possible to adjust the size of the screen using a cord that rotates the rolled part of the screen.

That is, existing blind apparatuses are formed such that a user can easily rotate the rolled screen over a window by pulling down a cord. However, according to this structure, force is concentrated on the side connected with the cord, so there is a problem that the blind apparatus becomes unbalanced or the joint between the rolled part of the screen and the cord is easily broken when it is used for along period of time.

When a cord is hung down too long, people, particularly, careless children easily trip on it, so there is a high possibility of a safety accident. Further, it is required to rotate the entire rolled screen with the balance maintained with a cord connected to a side of the rolled screen, so the rotation structure is unnecessarily complicated and there are many other problems.

CITATION LIST

Patent Literature

[Patent Literature 1] Korean Utility Model No. 20-0480955 (Jul. 29, 2016)

DISCLOSURE OF INVENTION

Technical Problem

The present invention has been made in an effort to solve the problems, and an object of the present invention is to provide a cordless blind apparatus that can be conveniently operated without a cord.

The object of the present invention is not limited to those described above and other objects may be made apparent to those skilled in the art from the following description.

Solution to Problem

A cordless blind apparatus according to the present invention includes: a roller that is fitted on a rotary shaft; a screen that is wound or unwound on the roller; a weight that is connected to the lower end of the screen and applies torque in a first direction in which the screen is unwound from the roller by gravity; an elastic member that applies torque in a second direction in which the screen is wound by applying elastic force to the roller; and a friction stopper assembly that generates friction force on the roller.

The friction force may offset the resultant force of the torque applied to the roller in the first direction and the torque applied to the roller in the second direction.

The elastic member may be a torsional elastic body that keeps elastic energy by elastically deforming when the roller is rotated.

The torsional elastic body may be a coil spring fitted on the rotary shaft.

The rotary shaft may include a first rotary shaft extending in the roller, and the friction stopper assembly may include first rotary block coupled to the roller to rotate with the roller and generating friction on the first rotary shaft.

The first rotary shaft may have threads on the outer side to be a male thread, and the first rotary block may have threads on the inner side of a hole formed through the center thereof to be a female thread that is thread-fastened to the screw.

The cordless blind apparatus may further include a friction member that is disposed on at least one of the outer side of the first rotary shaft and the inner side of the first rotary block to increase friction resistance.

The friction member may extend in the longitudinal direction of the first rotary shaft, on the outer side of the first rotary shaft.

The friction resistance of the friction member may change in the longitudinal direction of the first rotary shaft.

The friction member may be an elastic body that elastically deforms between the first rotary shaft and the first rotary block, and the thickness or the area of the friction member may change in the longitudinal direction of the first rotary shaft.

The friction member may have serrations on the surface being in contact with the first rotary block or the surface being in contact with the first rotary shaft.

At least of the height, the gap, and the shape of the serrations on the friction member may change in the longitudinal direction of the first rotary shaft.

The rotary shaft may include a second rotary shaft extending in the roller, and, may further include a second rotary block coupled to the roller to rotate with the roller, and the elastic member may be fixed to the second rotary block and the second rotary shaft at both ends, respectively.

A plurality of rollers may be arranged in parallel with each other, and a plurality of screens, weights, and elastic members may be provided to correspond to the plurality of rollers.

The cordless blind apparatus may further include a connection hook disposed at least between the plurality of screens or between the plurality of weights, and the friction member may be disposed on at least one of the plurality of rollers.

The connection hook may be slidably fitted in guide grooves formed on the weights.

Advantageous Effects of Invention

According to the present invention, it is possible to very conveniently operate the cordless blind apparatus even without using a cord that has been connected to a side of a roller in the related art. According to the cordless blind apparatus of the present invention, it is possible to very easily adjust the length of a screen by winding or unwinding it even without a cord, and it is also possible to stably maintain the adjusted length. Accordingly, it is possible to effective solve the problem that a cordless blind apparatus is unbalanced or the joint of a cord is broken due to repeated use. Further, it is possible to improve the aesthetic appearance of a cordless blind apparatus by simplifying the external appearance of the cordless blind apparatus, and it is also possible to prevent a safety accident that a person trips on a long cord. Therefore, the cordless blind apparatus can provide various effects.

MODE FOR THE INVENTION

Figure 1:
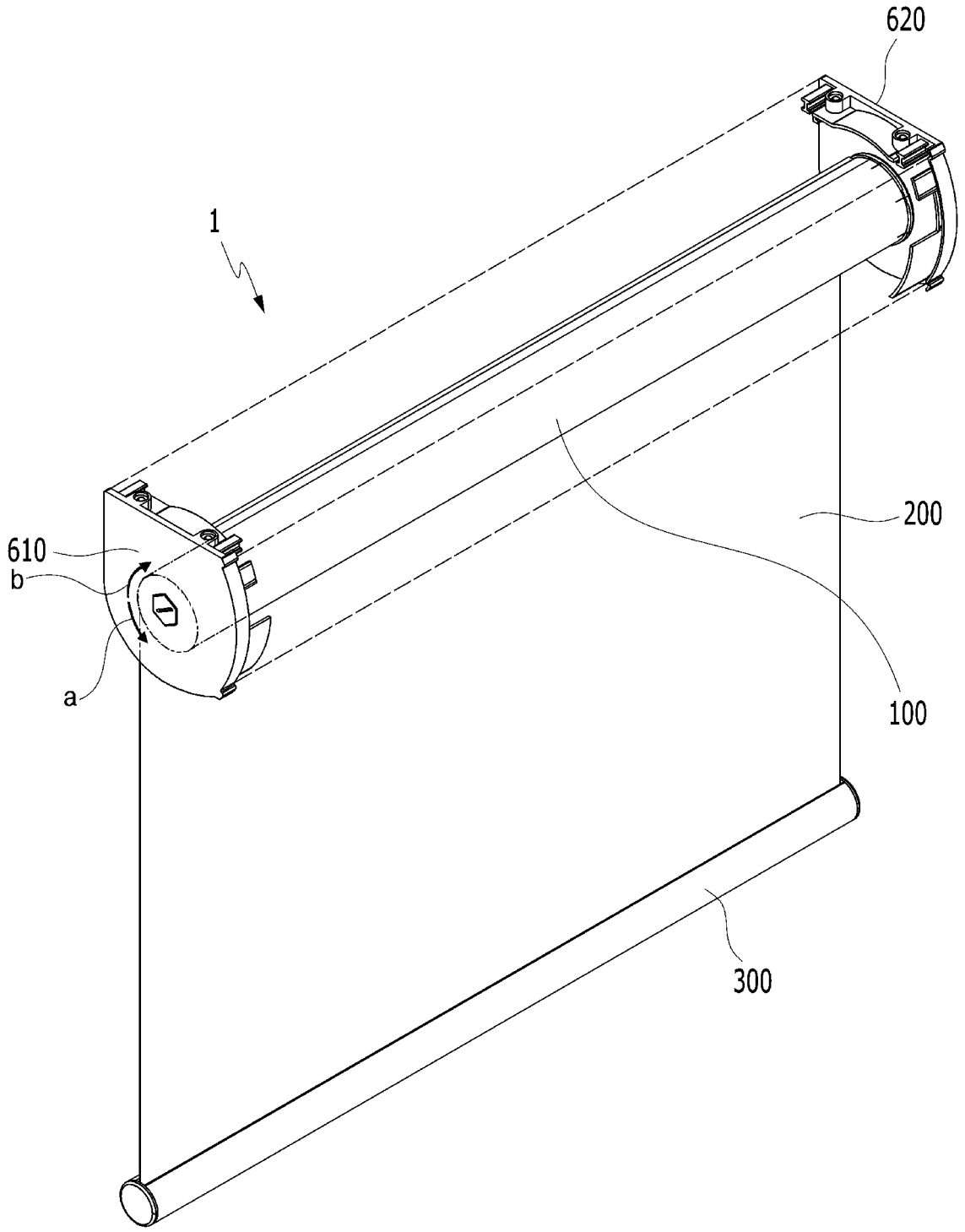
FIG. 1 is a perspective view showing a cordless blind apparatus according to an embodiment of the present invention.

The advantages and features of the present invention, and methods of achieving them will be clear by referring to the exemplary embodiments that will be described hereafter in detail with reference to the accompanying drawings. However, the present invention is not limited to the exemplary embodiments described hereafter and may be implemented in various ways, and the exemplary embodiments are provided to complete the description of the present invention and let those skilled in the art completely know the scope of the present invention and the present invention is defined by claims. Like reference numerals indicate the same components throughout the specification.

Hereinafter, a cordless blind apparatus according to an embodiment of the present invention is described in detail with reference to FIGS. 1 to 10.

Figure 2:
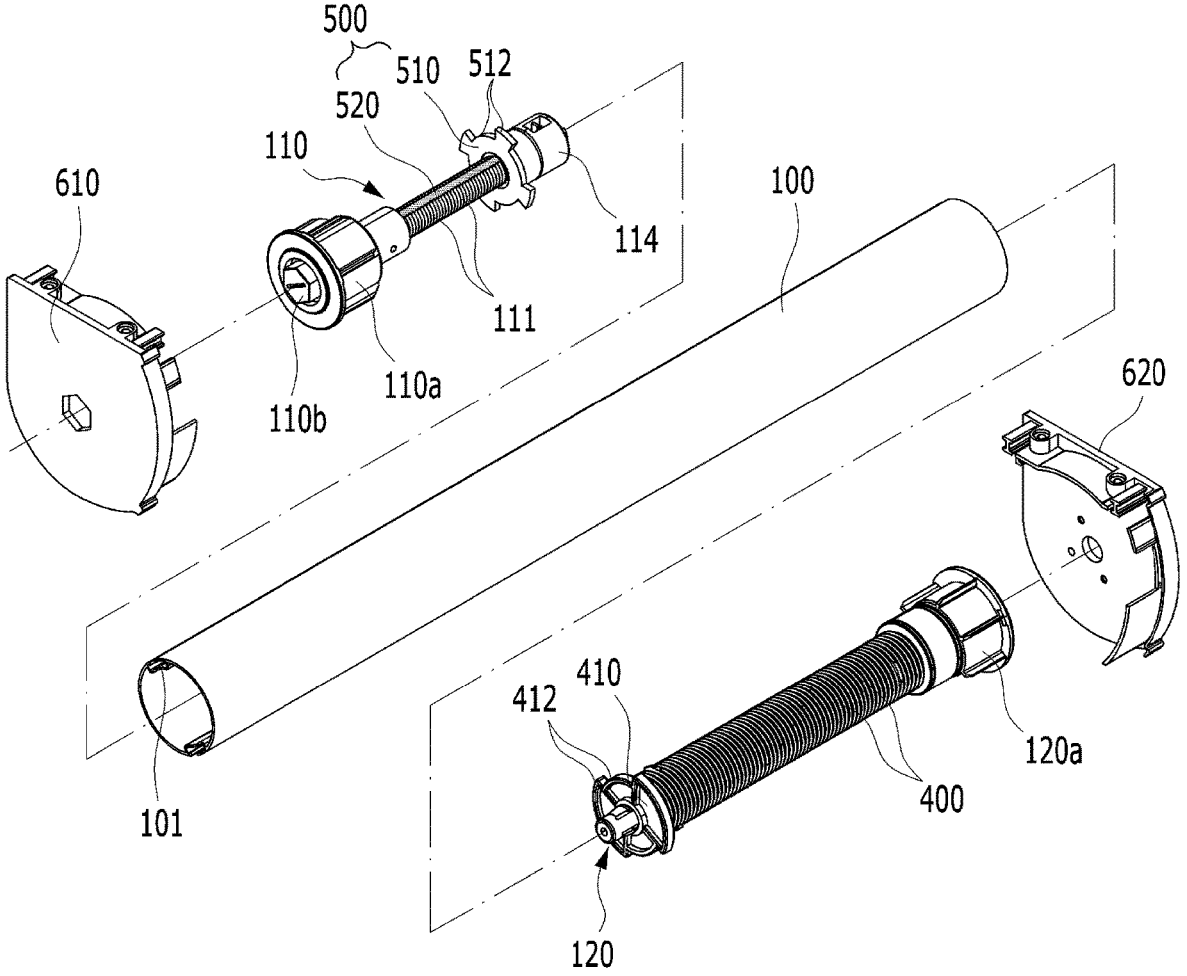
FIG. 2 is an exploded perspective view of a roller of the blind apparatus shown in FIG. 1.
Figure 3:
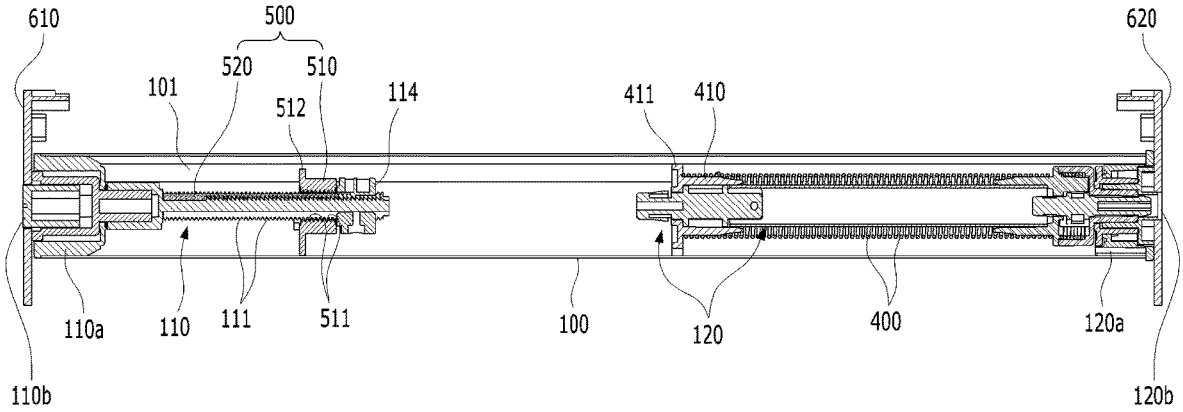
FIG. 3 is a cross-sectional view showing the inside of the roller of the blind apparatus shown in FIG. 1.

FIG. 1 is a perspective view showing a cordless blind apparatus according to an embodiment of the present invention, FIG. 2 is an exploded perspective view of a roller of the blind apparatus shown in FIG. 1, and FIG. 3 is a cross-sectional view showing the inside of the roller of the blind apparatus shown in FIG. 1.

Referring to FIGS. 1 to 3, a cordless blind apparatus 1 according to an embodiment of the present invention includes: a roller 100 that is coupled to a rotary shaft; a screen 200 that is wound or unwound on the roller 100; a weight 300 that is connected to the lower end of the screen 200 and applies torque to the roller 100 by gravity in a first direction (see 'a' in FIG. 1) in which the screen 100 is unwound; an elastic member 400 (see FIGS. 2 and 3) that applies torque in a second direction (see 'b' in FIG. 1) in which the screen 200 is wound by applying elastic force to the roller 100; and a friction stopper assembly 500 (see FIGS. 2 and 3) that generates friction on the roller 100. The cordless blind apparatus 1, as shown in the figures, has a structure with a cord completely removed, so it has a very simple external shape.

The cordless blind apparatus 1 is easily operated even without a cord by torques that are applied to the roller 100 in opposite directions. The torques are increased or decreased in balance, depending on the unwound length of the screen 200. Since the torques balance with each other, but act in opposite direction, it is possible to easily break the balance by applying minimum external force (which can be easily transmitted by touching the screen or the weight) and easily restore the balance by removing the external force. Accordingly, it is possible to rotate the roller 100 by applying external force in a desired direction or stop the roller 100 at the rotated position by removing the external force.

Further, there may be a subtle difference between the magnitudes of torques due to reasons related to the structure, design, and manufacturing process, but it is possible to solve this problem by generating friction force using the friction stopper assembly 500. It is possible to more easily maintain a stop status by removing the resultant force of opposite torques with friction force. Further, since appropriate resistance is applied by the friction generated by the friction stopper assembly 500, it is possible to prevent undesired rotation of the roller 100 and easily keep the roller 100 stopped until appropriate external force is transmitted. As described above, by using the pair of opposite torques and friction force, it is possible to very conveniently operate the blind apparatus even without a cord.

The cordless blind apparatus 1 having these characteristics is described hereafter in more detail with reference to the drawings. Other characteristics of the present invention will be known through the following description.

The roller 100 is formed in a cylindrical shape. The roller 100 may be formed in the hollow cylindrical shape, as shown in FIGS. 1 to 3. The roller 100 may be disposed between fixing brackets 610 and 620 to which a rotary shaft is fixed, and the fixing brackets 610 and 620 may be combined with a housing (indicated by dotted lines in FIG. 1) that keeps the roller 100 therein. Since the roller 100 is hollow, the rotary shaft can be inserted in the roller 100. Further, the elastic member 400 and the friction stopper assembly 500 can also be inserted in the roller 100. However, the roller 100 is not necessarily limited to a cylindrical shape and at least a portion of the roller 100 may be changed in an appropriate shape easy to wind or unwind the screen 200. The roller 100 can be fitted and rotated on rotary shafts (a first rotary shaft and a second rotary shaft).

The roller 100 may be fitted on one or more rotary shafts. As in an embodiment of the present invention, a first rotary shaft 110 and a second rotary shaft 120 may be coupled to both ends of the roller 100. By preparing separate rotary shafts and coupling them to different ends, it is possible to more efficiently use the internal space of the roller 100. However, the present invention is not limited thereto and a single rotary shaft may be fitted in the roller 100. A structure having the first rotary shaft 110 and the second rotary shaft 120 is exemplified in the following description of an embodiment of the present invention.

The screen 200 is wound or unwound on the roller 100. The screen 200 can be wound on the roller 100 or unwound from the roller 100 when the roller 100 is rotated. An end of the screen 200 may be connected to the roller 10 to rotate with the roller 100 and the other end may be connected and fixed to a weight 300. Assuming that the screen 200 is unwound when the roller 100 is rotated in a predetermined direction, the screen 200 can be wound when the roller 100 is rotated in the opposite direction. The screen 200 may be made of fabric, but is not limited thereto. The screen 200 may be made of various flexible materials.

The weight 300 is connected to the lower end of the screen 200. As shown in FIG. 1, as the weight 300 is connected to the lower end of the screen 200, so the screen 200 can be unrolled. The weight 300 has appropriate mass, so it transmits tension due to gravity to the screen 200, and the tension transmitted to the screen 200 can act as torque that rotates the roller 100. That is, the weight 300 is connected to the lower end of the screen 200, so it applies torque to the roller 100 in a first direction in which the screen 200 is unrolled by gravity. The weight 300 may be formed in a bar shape having a length corresponding to the width of the screen 200, but it may be formed in other various shapes.

The elastic member 400 applies torque in a second direction in which the screen 200 is wound, by applying elastic force to the roller 100. The elastic member 400 may be disposed in the roller 100, as shown in FIG. 2. That is, since the elastic member 400 is provided, torque is applied to the roller 100 in the opposite direction to the first direction in which the weight 300 applies torque, so the roller 100 can be balanced. The elastic member 400 may be a torsional elastic body that keeps elastic energy by elastically deforming with rotation of the roller 100 and the torsional elastic body may be a coil spring fitted on the outer side of the rotary shaft. For example, as shown in FIG. 2, the elastic member 400 that is a torsional elastic body may be a coil spring fitted on the outer side of the second rotary shaft 120, as shown in FIG. 2.

The more the roller 100 is rotated, the larger the deformation of the elastic member 400 and the larger the restoring force accordingly. The restoring force acts in the opposite direction to the rotation causing the deformation, so it generates opposite torque. For example, when the screen 200 is unwound, as the roller 100 is rotated in the unwinding direction, the torque in the opposite direction, that is, a winding direction (the second direction) is increased by elasticity. Further, since the length of the screen 200 increases when the screen 200 is unwound, the torque in the unwinding direction (the first direction) due to gravity is also increased by the sum of the weights of the weight 300 and the screen 200. Accordingly, the first-directional torque and the second-directional torque are increased in balance. By the balance of torques, it is possible to simply rotate the roller 100 and easily stop the roller 100 at a rotated position. Detailed operation will be described in more detail below.

The elastic member 400 is disposed between the second rotary shaft 120 and the roller 100 and can generate torque. The elastic member 400, for example, may be coupled to the roller 100 through a rotary block that is coupled to the roller 100 to rotate. As described above, the second rotary shaft 120 extends in the roller 100 and a second rotary block 410 that is coupled to the roller 100 to rotate with the roller 100 may be formed in the roller 100. Both ends of the elastic member 400, as shown in FIGS. 2 and 3, may be connected and fixed to the second rotary block 410 and the second rotary shaft 120, respectively. The second rotary shaft 120 may pass through the rotational center of the second rotary block 410 and a holder 412 formed around the outer side of the second rotary block 410 are fitted on guide rails 101 (see FIGS. 1 to 3) on the inner side of the roller 100, so the roller 100 and the second rotary block 410 can be rotated together.

According to this structure, when the roller 100 is rotated, the second rotary block 410 is also rotated and the end, which is connected to the second rotary block 410, of the elastic member 400 can be twisted and deformed. The second rotary shaft 120 rotatably supports the roller 100, but does not rotate itself, so a second end, which is fixed to the second rotary shaft 120, of the elastic member 400 is maintained fixed. Accordingly, torsion is generated between the first end and the second end of the elastic member 400, whereby elastic energy is kept. The elastic member 400 can be configured in this way. However, the configuration of the torsion spring 400 is not limited thereto and the elastic member 400 may be configured in other ways that can generate torque by applying elastic force to the roller 100.

The second rotary shaft 120 and the first rotary shaft 110 may be fixed to the fixing brackets 610 and 620, respectively. Fixing portions 110*b* and 120*b* may be formed in various shapes at the ends, which face the fixing brackets 610 and 620, of the first rotary shaft 110 and the second rotary shaft 120 to firmly fix the rotary shafts. For example, the fixing portions 110*b* and 120*b* may be formed in various ways such as a fitting structure using a projection and a hole or a thread-fastening structure. Further, rotary rings 110*a* and 120*a* may be rotatably fitted on the first rotary shaft 110 and the second rotary shaft 120, respectively, and as shown in FIG. 3, the rotary shafts 110*a* and 120*a* may be coupled to both ends of the roller 100. Accordingly, the roller 100 is supported by the rotary ring 110*a* and 120*a*, so it can be rotated on the rotary shafts.

The friction stopper assembly 500 includes a first rotary block 510 combined with the roller 100 to be rotated with the roller 110 and generating friction on the first rotary shaft 110. The first rotary shaft 110 also extends in the roller 100 and the first rotary block 510 is disposed in the roller 100 to rotate with the roller 100. The first rotary shaft 110 may pass through the rotational center of the first rotary block 510 and holders 512 are formed around the outer side of the first rotary block 510, as shown in FIGS. 2 and 3, so the first rotary block 510 can be fitted on the guide rails 101 in the roller 100. Accordingly, the roller 100 and the first rotary block 510 are rotated together. Further, the second rotary block 410 has the same structure, so it can be rotated with the roller 100.

The holders 412 and 512 of the first rotary block 510 and the second rotary block 410 can be slidably fitted on the guide rails 101 in the roller 100. Accordingly, the first rotary block 510 and the second rotary block 410 can rotate with the roller 100 and can horizontally move. As shown in FIGS. 1 to 3, the guide rails 101 extend in parallel with the first rotary shaft 110 and the second rotary shaft 120 and can guide the blocks sliding in parallel with the rotary shafts. Accordingly, the first rotary block 510 can horizontally move in the longitudinal direction of the first rotary shaft 110 while rotating, and the second rotary block 410 can also horizontally move in the longitudinal direction of the second rotary shaft 120 while rotating. Accordingly, since the rotary blocks horizontally move while rotating, they can more easily cause friction, so it is possible to more flexibly cope with elastic deformation.

The friction stopper assembly 500 can more effectively provide friction force to the roller 100 through thread-fastening or contact of a friction member 520. A combination of thread-fastening and the friction member 520 is exemplified in an embodiment of the present invention to be described below. However, it may be possible to apply only thread-fastening or the friction member 520 to the friction stopper assembly 500 in other embodiments. The friction stopper assembly 500 is described hereafter in more detail with reference to FIGS. 4 to 8.

Figure 4:
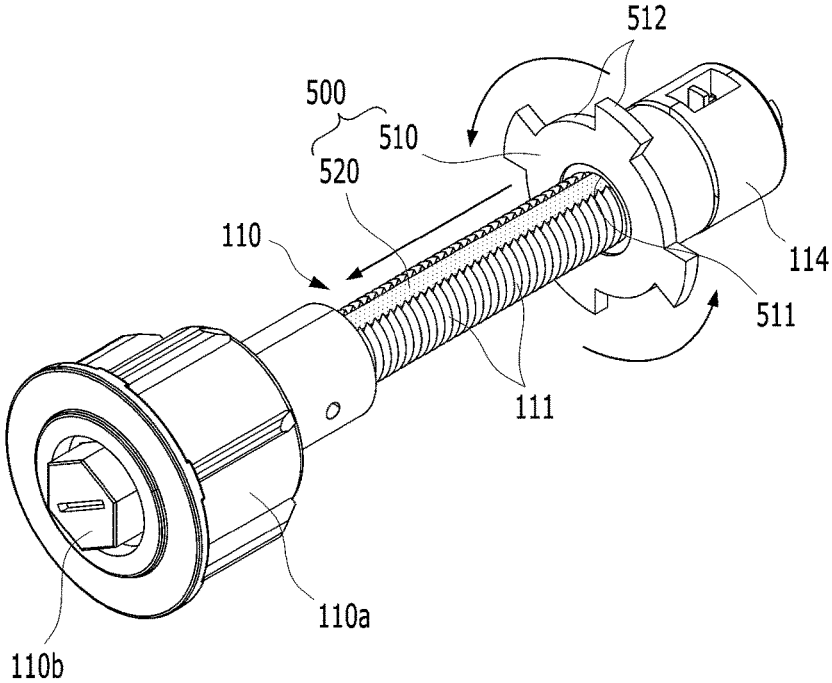
FIG. 4 is a perspective view enlarging a first rotary shaft and a friction stopper assembly of the blind apparatus shown in FIG. 1.
Figure 5:
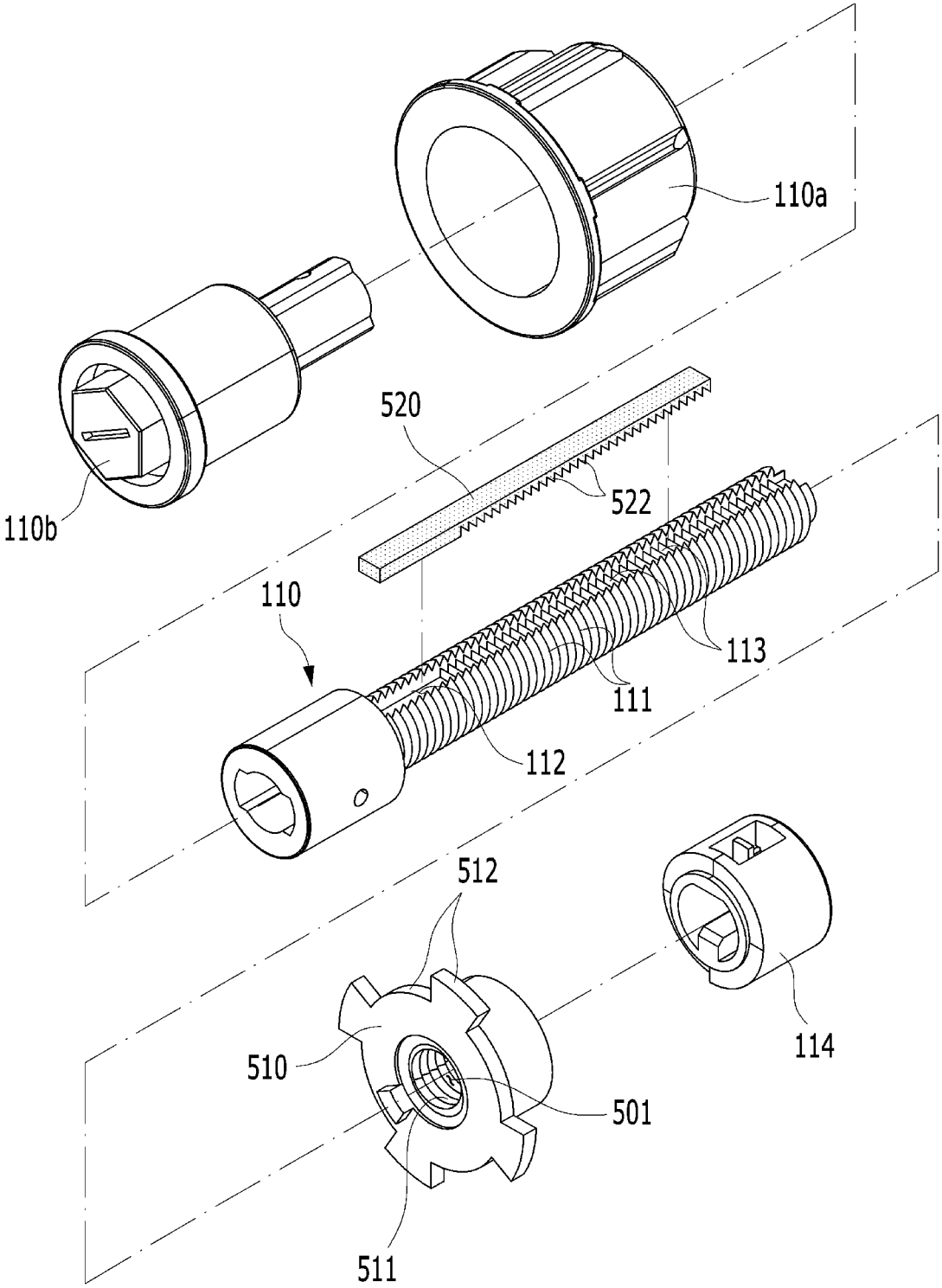
FIG. 5 is an exploded perspective view of the first rotary shaft and the friction stopper assembly shown in FIG. 4.
Figure 6:
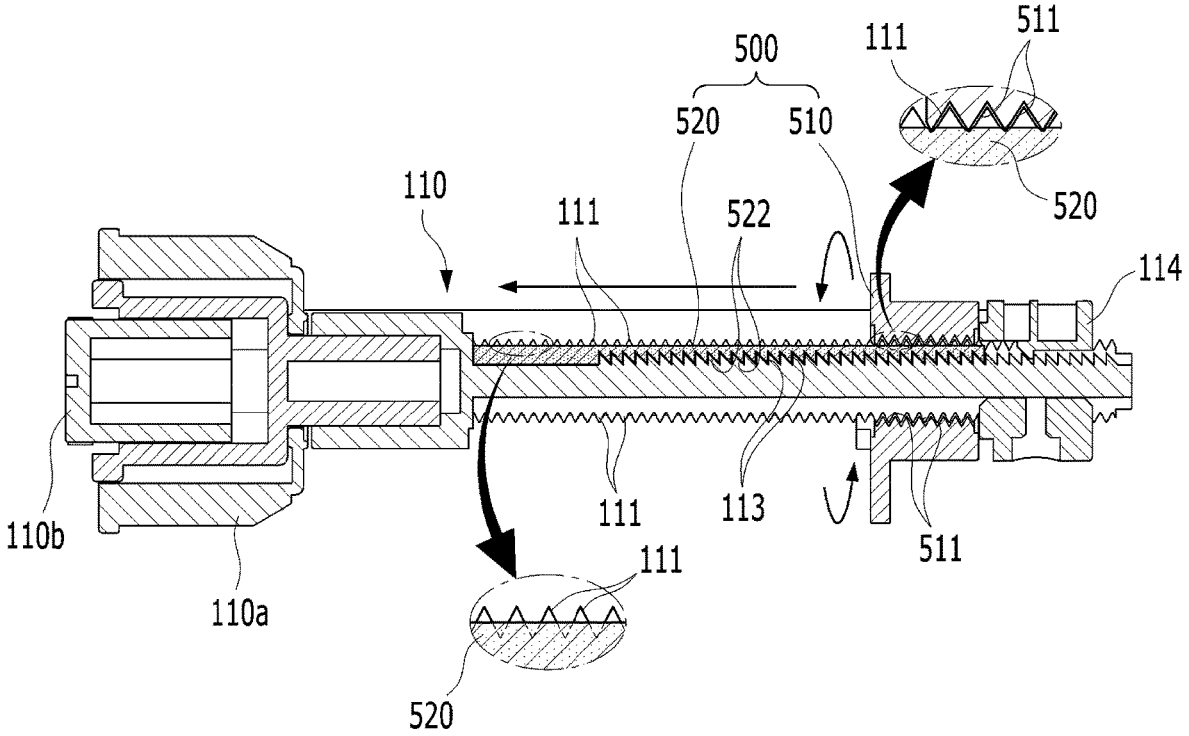
FIG. 6 is a cross-sectional view of the first rotary shaft and the friction stopper assembly shown in FIG. 4.

FIG. 4 is a perspective view enlarging the first rotary shaft and the friction stopper assembly of the blind apparatus shown in FIG. 1, FIG. 5 is an exploded perspective view of the first rotary shaft and the friction stopper assembly shown in FIG. 4, and FIG. 6 is a cross-sectional view of the first rotary shaft and the friction stopper assembly shown in FIG. 4.

The friction stopper assembly 500 is formed in the shape shown in FIGS. 4 to 6. The friction stopper assembly 500 may be formed on the first rotary shaft 110, and as described above, it can generate friction through the first rotary block 510 coupled to the roller 100 (see FIGS. 1 to 3) and rotating with the roller 100. The holders 512 are formed around the outer side of the first rotary block 510, so the first rotary block 510 can be combined with the roller 100, as described above. The holder 512 may have a structure such as a groove or a projection, and for example, grooves may be slidably fitted on the guide rails 101 (see FIGS. 1 to 3) of the roller 100. Accordingly, the first rotary block 510 can horizontally move in the longitudinal direction of the first rotary shaft 110 while rotating, as shown in FIGS. 4 and 6.

The first rotary shaft 110 has threads 111 on the outer side, as shown in FIGS. 4 to 6. The first rotary shaft 110 can be disassembled, and as shown in FIG. 5, the fixing portions 110*b* and 120*b* at an end and a stopper 114 at the other end can be combined or separated. Accordingly, the rotary ring 110*a* can be separated and combined and the first rotary block 510 can also be easily combined. The stopper 114 can set a limit so that the first rotary block 510 cannot horizontally move a predetermined distance or more by limiting the movement path of the first rotary block 510. The stopper 114 may be detachable, and if necessary, the position of the stopper 114 may be changed.

Threads 511 are formed on the inner side of a hole at the center of the first rotary block 510. The threads 511 may be formed in the inner side of a hole 501 at the center of the first rotary block 510. The threads 111 on the outer side of the first rotary shaft 110 may be male threads and the threads 511 on the inner side of the first rotary block 510 may be female threads that are fitted on the male threads. That is, the first rotary block 510 and the first rotary shaft 110 are engaged with each other through the threads 111 and 511 and generate friction by rotating. In particular, the first rotary block 510 is not simply rotated, but rotated by the threads 111 and 511, so it moves perpendicular to the rotational direction (see FIGS. 4 and 6). Accordingly, the first rotary block 510 can more effectively generate friction by moving along the threads 111 and 511.

The friction member 520 may be disposed on at least one of the outer side of the first rotary shaft 110 and the inner side of the first rotary block 510. It is exemplified in an embodiment of the present invention to be described below that the friction member 520 is disposed on the outer side of the first rotary shaft 110. However, in other embodiments, the friction member may be disposed on the inner side of the first rotary block 510 or on both of the outer side of the first rotary shaft 110 and the inner side of the first rotary block 510. When the friction member 520 is disposed on the first rotary shaft 110, as in an embodiment of the present invention, it is possible to more actively use the friction member 520 using the space of the first rotary shaft 110. The friction member 520 is described in more detail hereafter.

The friction member 520, as shown in FIGS. 4 to 6, may be disposed on the outer side of the first rotary shaft 110 and extend in the longitudinal direction of the first rotary shaft 110. Accordingly, as shown in FIGS. 4 and 6, while the first rotary block 510 rotates and moves, the friction member 520 can more effectively generate friction in contact with the threads 511 of the first rotary block 510. That is, the friction member 520 extends in the longitudinal direction of the first rotary shaft 110 and is brought in contact with the first rotary block 510 moving in the longitudinal direction of the first rotary shaft 110, so it can generate friction, depending on a change in position of the first rotary block 510.

The friction member 520, as shown in FIG. 5, may be inserted in a long groove 112 formed on the outer side of the first rotary shaft 110. The long groove 112 may be formed across the threads 111. Fixing projections 113 and 522 that are fitted to each other are formed on the contact surfaces of the long groove 112 and the friction member 520, so the friction member 520 can be effectively fixed at the position. The friction member 520 may be formed in a bar shape that is easily inserted in the long groove 112, and the thickness can be appropriately changed to generate appropriate friction. The contact surface, which faces the first rotary block 510, of the friction member 520 may be maintained at the height shown in FIG. 6.

As shown in FIG. 6, the contact surface, which faces the first rotary block 510, of the friction member 520 may extend between the ridges and grooves of the threads 111 of the first rotary shaft 110 (see the enlarged view in FIG. 6). Accordingly, at least some of the threads 511 of the first rotary block 510 can generate appropriate friction by pressing the surface of the friction member 520. The portion, which is in contact with the first rotary block 510, of the friction member 520 can keep in contact by elastically deforming (see the enlarged view in FIG. 6). Accordingly, friction force can be more effectively generated and transmitted to the roller 100 (see FIGS. 1 to 3).

On the other hand, at least a portion of the friction member 520 may be appropriately modified. The friction member 520 may be appropriately modified so that friction is increased or decreased at a specific position on the friction member 520. The friction member 520 may be formed such that friction resistance is changed in the longitudinal direction of the first rotary shaft 110, and accordingly, the first rotary block 510 can generate different intensities of friction at different positions while moving in the longitudinal direction of the first rotary shaft 110. A modification of the friction member 520 is described hereafter in more detail with reference to FIGS. 7 and 8.

Figure 7A:
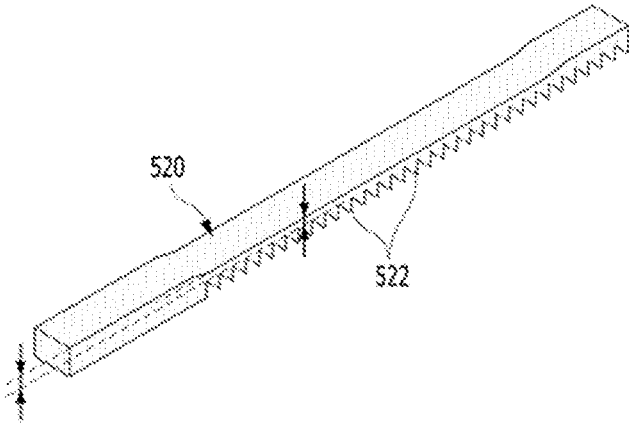
FIGS. 7A-7C are perspective views showing a modification of the friction stopper assembly.
Figure 7B:
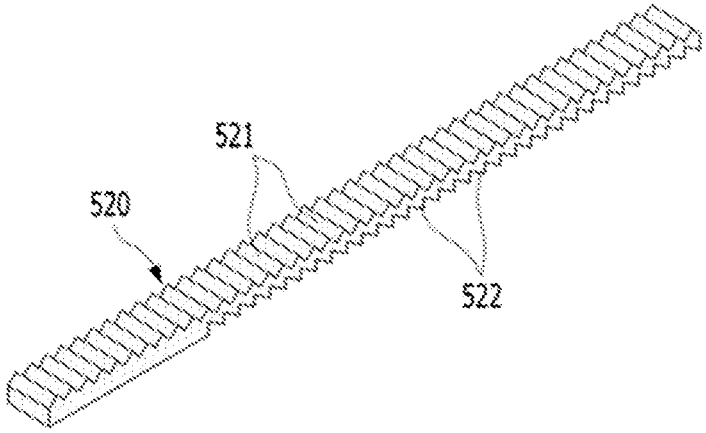
Figure 7C:
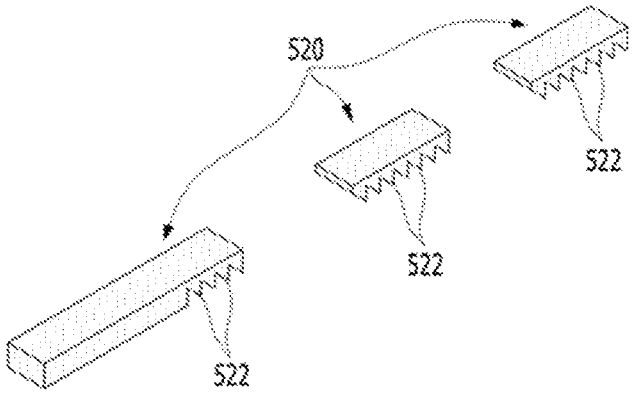
Figure 8A:
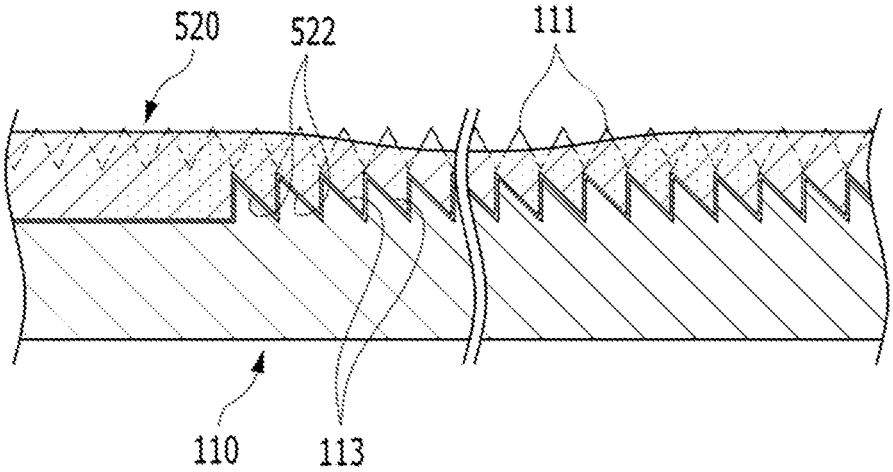
FIGS. 8A-8B are partial enlarged views showing an example of applying the friction stopper assembly shown in FIGS. 7A-7C.
Figure 8B:
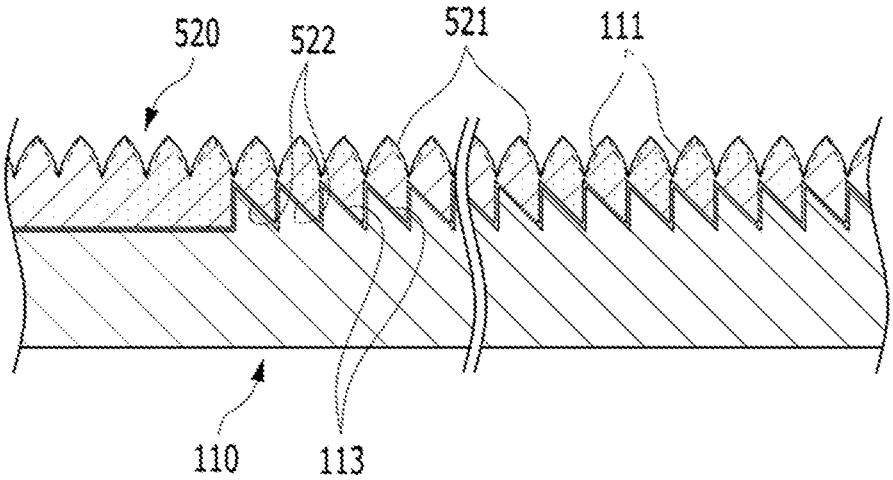

FIG. 7 is a perspective view showing a modification of the friction stopper assembly and FIG. 8 is a partial enlarged view showing an example of applying the friction stopper assembly shown in FIG. 7.

For example, the friction member 520 may be modified, as shown in FIG. 7. The friction member 520 is an elastic body that is elastically deformed between the first rotary shaft 110 (see FIGS. 4 to 6) and the first rotary block 510 (see FIGS. 4 to 6) and the thickness or the area of the friction member 520 may be changed in the longitudinal direction of the first rotary shaft 110. As shown in (a) of FIG. 7, the thickness of the friction member 520 may be changed to increase friction at a specific position. Accordingly, it is possible to relatively increase friction force at a position where the first-directional torque and the second-directional torque do not balance with each other.

That is, when the roller 100 (see FIGS. 1 to 3) is rotated and the screen 200 (see FIGS. 1 to 3) is fully wound or the roller 100 is rotated in the opposite direction and the screen 200 is fully unwound, balance between the first-directional torque and the second-directional torque may be unexpectedly broken due to insufficient or excessive restoring force of the elastic member 400. In this case, it may be very difficult to keep the roller 100 at the rotated position. Accordingly, by providing friction force at this position, it is possible to stop the roller 100 by more effectively offsetting the resultant force of the first-directional torque and the second-directional torque.

For example, as shown in (a) of FIG. 7, when the thicknesses of both end portions of the friction member 520 is increased, the contact surface, which faces the first rotary block 510 (see FIGS. 4 to 6), of the friction member 520 is relatively increased in height at the portions. Accordingly, the friction between the contact surface and the first rotary block 510 is increased. Both end portions of the friction member 520 stops the first rotary block 510 and also stops rotation of the roller 100, so the roller 100 can be positioned to correspond to the fully wound or unwound position of the screen 200. The roller 100 can be more effectively maintained stopped by increasing friction at such specific positions.

Further, as shown in (b) of FIG. 7, serrations 521 may be formed on the surface, which is in contact with the first rotary block 510 (see FIGS. 4 to 6), of the friction member 520. As described above, when the friction member is disposed on the first rotary block 510, the serrations 521 may be formed on the surface that is in contact with the first rotary shaft 110 (see FIGS. 4 to 6) of the friction member. The serrations 521, for example, may be arranged to correspond to the threads 111 of the first rotary shaft 110, and as shown in (b) of FIG. 8, they may be formed wider than the threads 111 to generate friction. As described above, since the serrations 521 are formed on the friction member 520, appropriate friction force can be generated and transmitted to the roller 100 (see FIGS. 1 to 3).

It can also be possible to increase friction force at specific positions by appropriately modifying the serrations 521. It is possible to increase or decrease friction by changing at least one of the height, gap, and shape of the serrations 521 in the longitudinal direction of the first rotary shaft 110, that is, the extension direction of the friction member 520 in FIGS. 7 and 8. For example, as described above, it is possible to increase friction force at the corresponding positions by increasing the height, decreasing the gap, or increasing the width of the serrations 521 at both end portions of the friction member 520.

Not one, but a plurality of friction members 520 may be arranged at different positions. As shown in (c) of FIG. 7, it is possible to additionally provide the friction members 520 only at positions where friction needs to be increased. For example, one or more friction members 520 may be separately inserted at different positions in the long groove 112 (see FIG. 5). In this case, the friction members 520 can be easily fixed by the fixing projections 522. As described above, by appropriately modifying the friction member 520 in various shapes, it is possible to more effectively provide friction force to the roller 100.

Hereinafter, the operation of the cordless blind apparatus is described in more detail with reference to FIGS. 9 and 10.

Figure 9A:
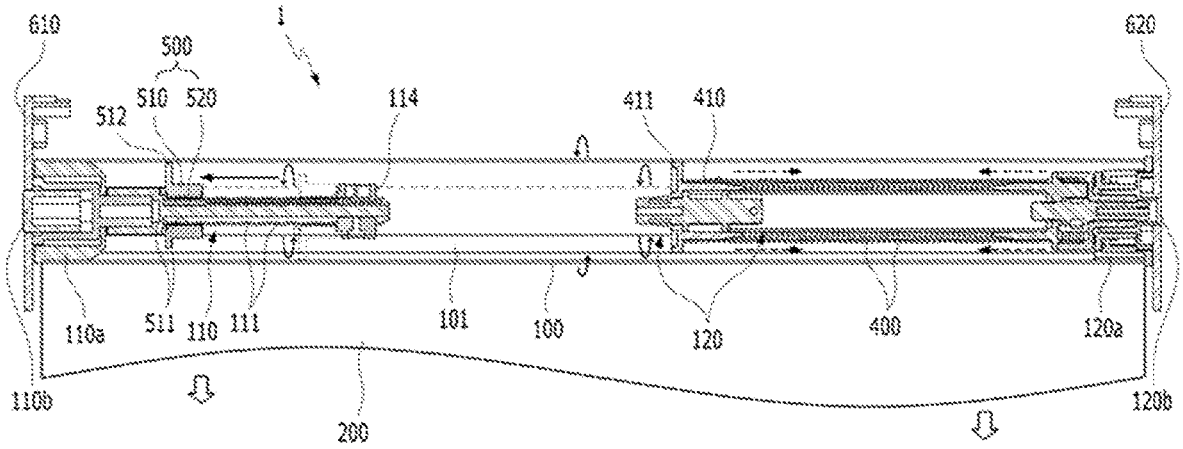
FIGS. 9A-9B and 10A-10B are views showing the operation of the blind apparatus shown in FIG. 1.
Figure 9B:
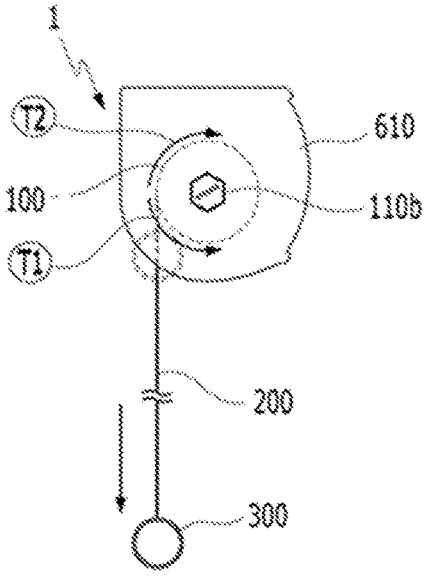
Figure 10A:
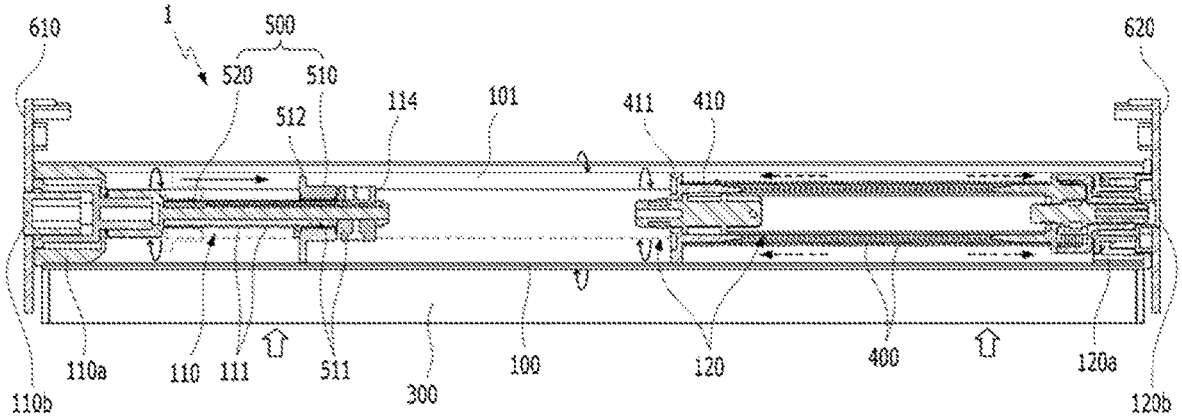
Figure 10B:
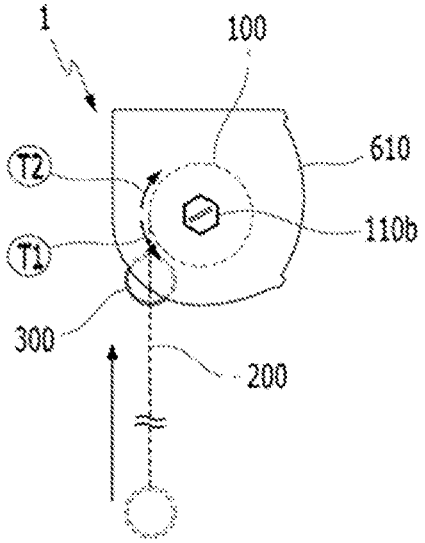

FIGS. 9 and 10 are views showing the operation of the blind apparatus shown in FIG. 1.

The cordless blind apparatus 1 can be very easily operated even without a cord because the structural characteristics described above. The weight 300 applies the first-directional torque T1 (see FIGS. 9 and 10) to the roller 100 in which the screen 200 is unwound, while the elastic member 400 applies the second-directional torque T2 (see FIGS. 9 and 10) in which the screen 200 is wound. Accordingly, it is possible to keep the balance of the roller 100 at various rotating positions and to easily keep the roller 100 stopped using the friction force generated by the friction stopper assembly 500.

That is, it is possible to easily break the balance and adjust the length of the screen 200 by applying a minimum external force to the cordless blind apparatus 1 (by simply touching the screen or the weight), using the torques T1 and T2 that are increased or decreased and applied in opposite directions, depending on the unwound length of the screen 200. Further, it is possible to maintain the screen 200 at the length by returning to the balanced state by removing the external force. Even if subtle unbalance is generated between the torques T1 and T2, the resultant force of the opposite torques T1 and T2 is offset by friction forces, so the stopped state can be more easily maintained.

For example, the screen 200 can be unwound, as shown in (b) of FIG. 9. In this case, as the roller 100 is rotated, as shown in (a) of FIG. 9, the second rotary block 410 combined with the roller 100 is also rotated. Accordingly, the elastic member 400 connected to the second rotary block 410 is deformed, and elastic energy is kept. The elastic member 400 deforms to correspond to the unwound length of the screen 200, whereby the restoring force is increased. The restoring force acts as the first-directional torque T1, as shown in (b) of FIG. 9.

Further, the second-directional torque T2 is also increased. The load as much as the unwound length of the screen 200 is added to the load of the weight 300, and the gravitational action is enhanced. Accordingly, the tension in the screen 200 is increased by the gravity and the increased tension acts as the second-directional torque T2. The second-directional torque T2 is generated in the exact opposite direction to the first-directional torque T1, so balance can be maintained. It is possible to adjust the magnitudes of the first-directional torque T1 and the second-directional torque T2 to be the same by adjusting the modulus of elasticity of the elastic member 400 or the load of the weight 300.

As shown in (a) of FIG. 9, the first rotary block 510 generates friction force by moving on the first rotary shaft 110. The friction force acts on the roller 100, thereby keeping the roller 100 stopped. It is possible to more effectively generate friction force, using the structure including the friction member 520 and the thread-fastening between the first rotary block 510 and the first rotary shaft 110. Even if there is a subtle difference between the first-directional torque T1 and the second-directional torque T2, the friction force on the roller 100 removes the difference, thereby keeping the roller 100 stopped. That is, even if the resultant force of the first-directional torque T1 and the second-directional torque T2 that are applied in opposite directions remains, the resultant force is offset by friction force, whereby the roller can be effectively maintained stopped.

This action is performed in the same principle even when the screen 200 is wound, as shown in FIG. 10. As shown in (b) of FIG. 10, when the screen 200 is wound, the roller 100 is rotated in the opposite direction, as shown in (a) of FIG. 10, the deformation of the elastic member 400 reduces and the original shape is restored, and the kept elastic energy is reduced and the restoring force is also decreased. Accordingly, the first-directional torque T1 correspondingly reduces. Further, the unwound length of the screen 200 reduces and the gravitational action is made only by the load of the weight 300, so the second-directional torque T1 applied to the roller 100 is correspondingly decreased. Further, since the first rotary block 510 also generates friction force by moving while rotating in the opposite direction, the first-directional torque T1 and the second-directional torque T2 are balanced and the roller 100 can be maintained stopped by the friction force.

That is, regardless of winding or unwinding of the screen 200, the first-directional torque T1 and the second-directional torque T2 is increased or decreased in balance and the friction stopper assembly 500 stops the roller 100 by generating friction force. A user can easily adjust the length of the screen 200 by applying minimum external force that is enough to break the balance, and can maintain a desired length at a desired position by removing the external force. The operation can be very easily achieved only by simply touching up or down the screen 200 or the weight 300 connected to the screen 200. Accordingly, it is possible to obtain a remarkably improved and convenient use environment using the cordless blind apparatus 1 of the present invention.

Hereinafter, a cordless blind apparatus according to another embodiment of the present invention is described in detail with reference to FIGS. 11 to 14. For clear and simple description, differences from the previous embodiment are described and description of the other components not specifically stated is substituted with the above description.

Figure 11A:
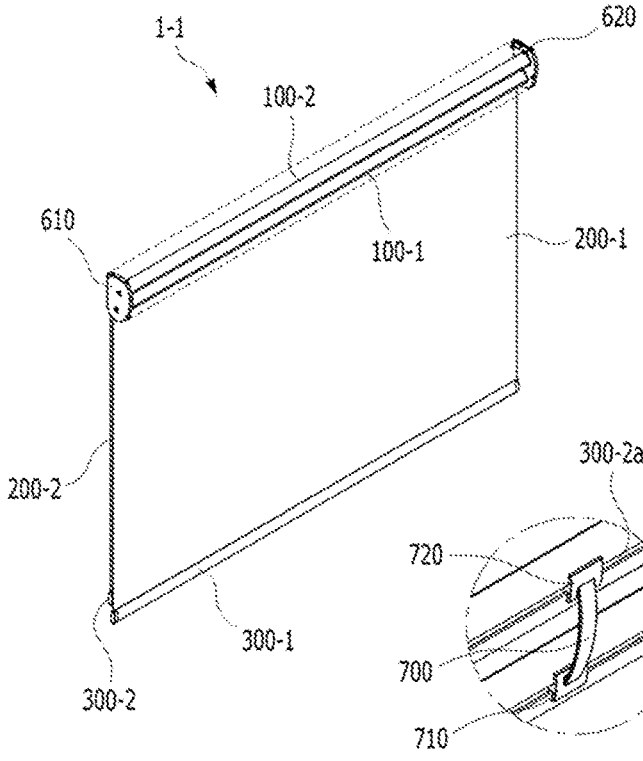
FIGS. 11A-11B are perspective views showing cordless blind apparatuses according to other embodiments of the present invention in different directions.
Figure 11B:
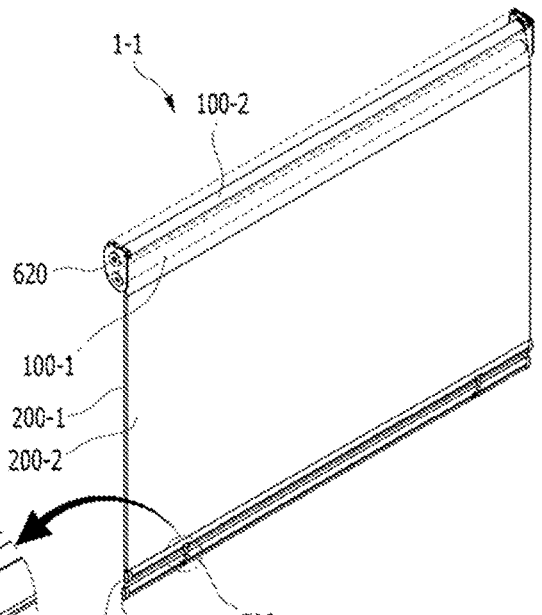
Figure 12A:
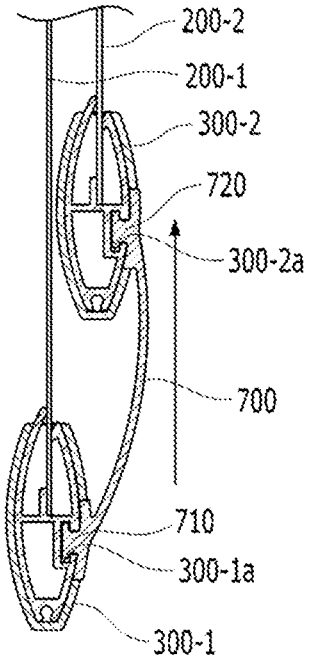
FIGS. 12A-12B are cross-sectional views showing a weight and a coupling ring of the blind apparatus shown in FIGS. 11A-11B.
Figure 12B:
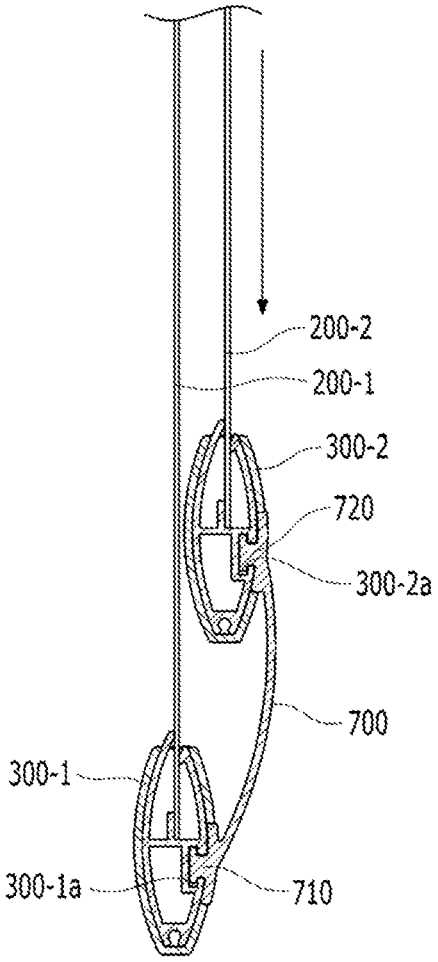
Figure 13A:
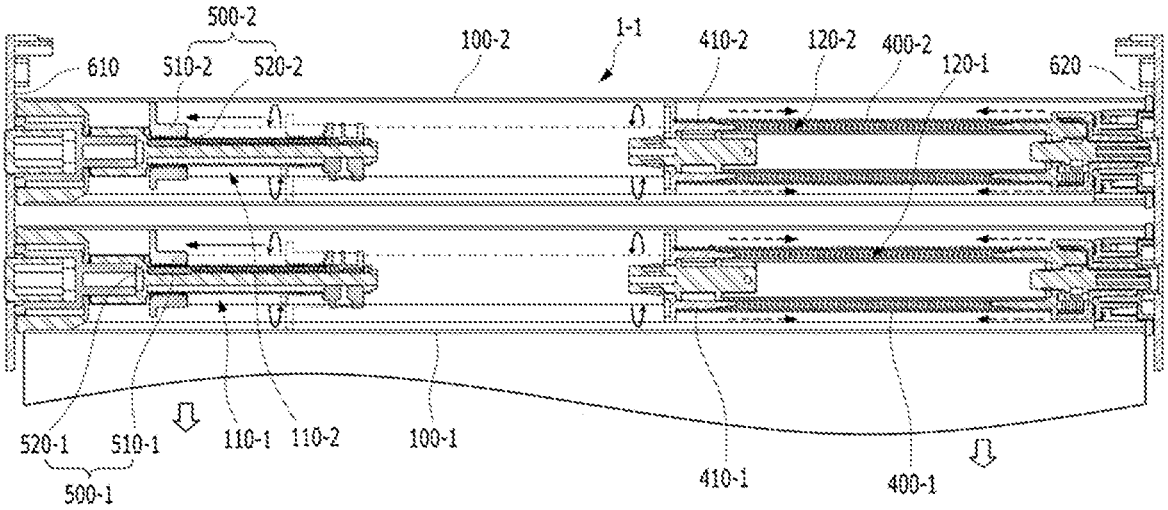
FIGS. 13A-13B and 14A-14B are views showing the operation of the blind apparatus shown in FIGS. 11A-11B.
Figure 13B:
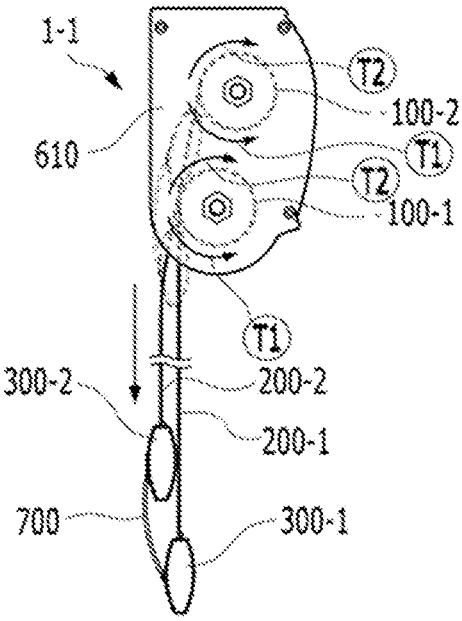
Figure 14A:
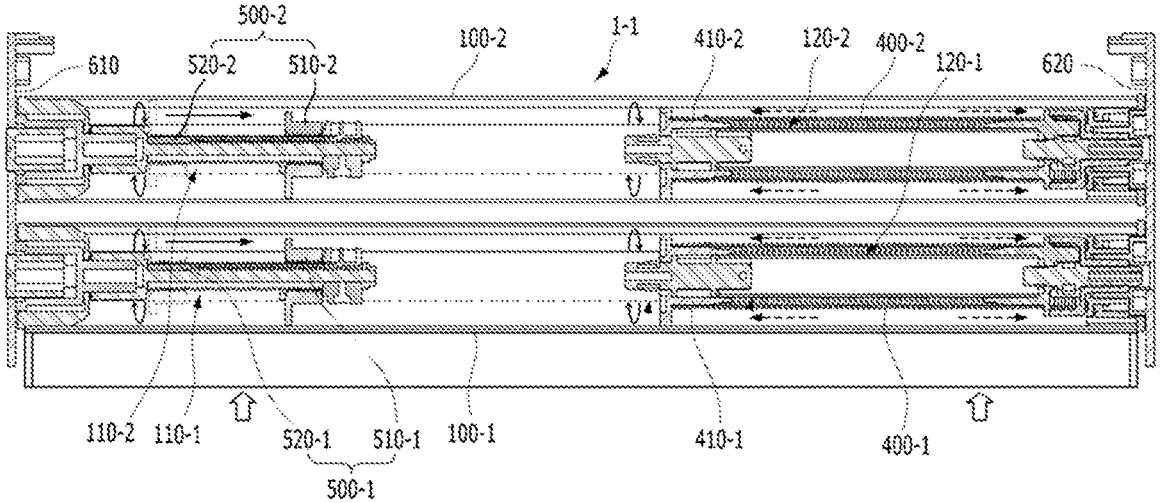
Figure 14B:
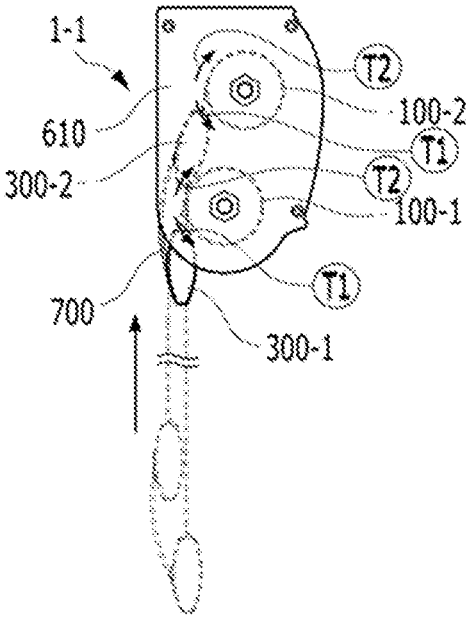

FIG. 11 is a perspective view showing cordless blind apparatuses according to other embodiments of the present invention in different directions, FIG. 12 is a cross-sectional sectional view showing a weight and a coupling ring of the blind apparatus shown in FIG. 11, and FIGS. 13 and 14 are views showing the operation of the blind apparatus shown in FIG. 11.

Referring to FIGS. 11 to 14, a cordless blind apparatus 1-1 according to another embodiment of the present invention includes a plurality of rollers 100-1 and 100-2, and a plurality of screens 200-1 and 200-2, weights 300-1 and 300-2, and elastic members 400-1 and 400-2 (see FIGS. 13 and 14) in correspondence to the rollers 100-1 and 100-2. A plurality of friction stopper assemblies 500-1 and 500-2 (see FIGS. 13 and 14) may be provided to correspond to the roller 100-1 and 100-2, but a friction stopper assembly may be formed on at least only one of the rollers 100-1 and 100-2 if necessary. Using this structure, it is possible to easily operate the plurality of rollers 100-1 and 100-2 and easily adjust the lengths of the screens 200-1 and 200-2 overlapping each other without a cord.

The plurality of rollers 100-1 and 100-2 are arranged in parallel with each other, as shown in FIGS. 11, 13, and 14. Each roller 100-1 and 100-2 may be both rotatably disposed between fixing brackets 610 and 620. The rollers 100-1 and 100-2 may be fitted on rotary shafts, respectively, to rotate and the rotary shafts may be coupled to the fixing brackets 610 and 620. The rotary shafts may include first rotary shafts 110-1 and 110-2 (see FIGS. 13 and 14) and second rotary shafts 120-1 and 120-2 (see FIGS. 13 and 14) that are inserted in both end portions of rollers 100-1 and 100-2, respectively. As shown in FIGS. 13 and 14, different first rotary shafts 110-1 and 110-2 inserted in different rollers 100-1 and 100-2 may be coupled to one fixing bracket 610, and different second rotary shafts 120-1 and 120-2 inserted in different rollers 100-1 and 100-2 may be coupled to the other fixing bracket 620.

The screens 200-1 and 200-2, weights 300-1 and 300-2, elastic members 400-1 and 400-2 are provided to correspond to the rollers 100-1 and 100-2. That is, a plurality of screens 200-1 and 200-2, weights 300-1 and 300-2, elastic members 400-1 and 400-2 can be provided to correspond to the plurality of rollers 100-1 and 100-2. Accordingly, a structure that is substantially the same as the operational structure described in the previous embodiment can be provided in the rollers 100-1 and 100-2, as shown in FIGS. 13 and 14. Accordingly, the rollers 100-1 and 100-2 can wind or unwind corresponding screens 200-1 and 200-2 by rotating, as described above. Detailed description of the operation of the rollers 100-1 and 100-2 refers to the above description.

In particular, the cordless blind apparatus 1-1 according to another embodiment of the present invention includes a connection hook 700 at least one of between the screens 200-1 and 200-1 or between the weights 300-1 and 300-2. The connection hook 700 may be provided between the weights 300-1 and 300-2, as shown in (b) of FIG. 11. Accordingly, it is possible to simultaneously operate the rollers 100-1 and 100-2 and more conveniently wind or unwind the screens 200-1 and 200-2. The connection hook 700 may be slidably fitted in guide grooves 300-1*a* and 300-2*a* formed on the weights 300-1 and 300-2, respectively.

The guide grooves 300-1*a* and 300-2*a* may be formed in the shapes shown in (b) of FIG. 11 and FIG. 12. As shown in FIG. 12, the guide grooves 300-1*a* and 300-2*a* may be formed inward on the weights 300-1 and 300-2, and they may be extended in the longitudinal directions of the weights 300-1 and 300-2, as shown in (b) of FIG. 11. Sliders 710 and 720 at both ends of the connection hook 700 are inserted in the guide grooves 300-1*a* and 300-2*a*, so the connection hook 700 can slide. One connection hook 700 or a pair of connection hooks 700 may be provided and they may be disposed at different positions on the weights 300-1 and 300-2. Accordingly, it is possible to more easily balance the different screens 200-1 and 200-2.

That is, by sliding the connection hook 700 along the guide grooves 300-1*a* and 300-2*a*, it is possible to change the connection point between the weights 300-1 and 300-2 and change the position where tension is applied through the connection hook 700. Accordingly, it is possible to uniformly adjust tension between the screens 200-1 and 200-2 connected to the weights 300-1 and 300-2, respectively. For example, by symmetrically positioning a pair of connection hooks 700 by sliding them to both ends of the weights 300-1 and 30-2, as shown in (b) of FIG. 11, it is possible to uniformly adjust the tension between the screens 200-1 and 200-2.

Accordingly, it is possible to very conveniently and uniformly adjust the lengths of the screens 200-1 and 200-2. When a user adjusts the lengths of the screens 200-1 and 200-2, as shown in (a) and (b) of FIG. 12, by uniformly distributing and transmitting tension through the connection hook 700 between the weights 300-1 and 300-2, he/she can uniformly move the weights 300-1 and 300-2 only by touching any one of the weights 300-1 and 300-2. If necessary, it is possible to appropriately adjust the thickness and length of the connection hook 700, and particularly, it is possible to change relative positions of the weights 300-1 and 300-2 by changing the length of the connection hook 700. Accordingly, it is possible to freely change the overlapping amount of the screens 200-1 and 200-2.

When the connection hook 700 is formed in this way, the friction stopper assemblies 500-1 and 500-1 may be formed on at least one of the rollers 100-1 and 100-2. Although a plurality of friction stopper assemblies 500-1 and 500-2 is formed on the plurality of rollers 100-1 and 100-2 in the drawings (see FIGS. 13 and 14), a friction stopper assembly may be formed on only one of the rollers 100-1 and 100-2, if necessary. That is, since the weights 300-1 and 300-2 and the screens 200-1 and 200-2 are connected and tension is transmitted through the connection hook 700, the friction acting on any one of the rollers 100-1 and 100-2 can also be easily transmitted to the other rollers 100-1 and 100-2 due to a change in tension. Accordingly, it is possible to easily operate the cordless blind apparatus 1-1 even without forming a friction stopper assembly on all the plurality of rollers 100-1 and 100-2. The number of the friction stopper assemblies 500-1 and 500-2 can be appropriately changed and the friction force that is generated by the friction stopper assemblies 500-1 and 500-2 can also be appropriately increased or decreased in consideration of the number of the rollers 100-1 and 100-2.

The cordless blind apparatus 1-1 having this configuration according to another embodiment of the present invention can also be very easily operated even without a cord, similar to the cordless blind apparatus described above. That is, as shown in FIGS. 13 and 14, it is possible to easily break the balance and adjust the length of the screens 200-1 and 200-2 by applying a minimum external force to the cordless blind apparatus 1-1 (by simply touching the screen or the weight), using the torques T1 and T2 that are increased or decreased and applied in opposite directions, depending on the unwound length of the screens 200-1 and 200-2. Further, it is possible to maintain the screens 200-1 and 200-2 at the length by returning to the balanced state by removing the external force. Even if subtle unbalance is generated between the torques T1 and T2, the resultant force of the opposite torques T1 and T2 is offset by friction forces, so the stopped state can be more easily maintained. Accordingly, it is possible to obtain a remarkably improved and convenient use environment using the cordless blind apparatus 1-1 of the present invention.

Although exemplary embodiments of the present invention were described above with reference to the accompanying drawings, those skilled in the art would understand that the present invention may be implemented in various ways without changing the necessary features or the spirit of the prevent invention. Therefore, it should be understood that the exemplary embodiments are not limiting but illustrative in all aspects.

REFERENCE SIGNS LIST

1, 1-1: Cordless blind apparatus
100, 100-1, 100-2: Roller
101: Guide rail
110, 110-1, 110-2: First rotary shaft
110*a*, 120*a*: Rotary ring
110*b*, 120*b*: Fixing portion
111, 511: Thread
112: Long groove
113, 522: Fixing projection
114: Stopper
120, 120-1, 120-2: Second rotary shaft
200, 200-1, 200-2: Screen
300, 300-1, 300-2: Weight
300-1*a*, 300-2*a*: Guide groove
400, 400-1, 400-2: Elastic member
410, 410-1, 410-2: Second rotary block
411, 512: Holder
500: Friction stopper assembly
510, 510-1, 510-2: First rotary block
501: Hole
520, 520-1, 520-2: Friction member
521: Serration
610, 620: Fixing bracket
700: Connection hook
710, 720: Slider
T1: First-directional torque
T2: Second-directional torque

INDUSTRIAL APPLICABILITY

The present invention relates to a cordless blind apparatus that can be very conveniently operated even without a cord that has been connected to a side of a roller in the related art, so it is possible to very easily adjust the length of a screen by winding or unwinding the screen even without a cord and it is also possible to stably maintain the adjusted length, and thus the cordless blind apparatus has high industrial applicability. According to the cordless blind apparatus of the present invention, it is possible to effective solve the problem that a cordless blind apparatus is unbalanced or the joint of a cord is broken due to repeated use. Further, it is possible to improve the aesthetic appearance of a cordless blind apparatus by simplifying the external appearance of the cordless blind apparatus and it is also possible to prevent a safety accident that a person trips on a long cord. Therefore, the cordless blind apparatus can provide various effects and has high industrial applicability.

The invention claimed is:

1. A cordless blind apparatus comprising:
a roller that is fitted on a rotary shaft;
a screen that is wound or unwound on the roller;
a weight that is connected to a lower end of the screen and applies torque in a first direction in which the screen is unwound from the roller by gravity;
an elastic member that applies torque in a second direction in which the screen is wound, by applying elastic force to the roller; and
a friction stopper assembly that generates friction force on the roller,
wherein the rotary shaft includes a first rotary shaft extending in the roller, and the friction stopper assembly includes a first rotary block coupled to the roller to rotate with the roller and generate friction on the first rotary shaft,
wherein the apparatus further comprises a friction member that is disposed on at least one of an outer side of the first rotary shaft and an inner side of the first rotary block to increase friction resistance,
wherein the friction member extends in a longitudinal direction of the first rotary shaft on the outer side of the first rotary shaft, and
wherein the friction resistance of the friction member changes in the longitudinal direction of the first rotary shaft.

2. The cordless blind apparatus of claim 1, wherein the friction force offsets a resultant force of the torque applied to the roller in the first direction and the torque applied to the roller in the second direction.

3. The cordless blind apparatus of claim 1, wherein the elastic member is a torsional elastic body that keeps elastic energy by elastically deforming when the roller is rotated.

4. The cordless blind apparatus of claim 3, wherein the torsional elastic body is a coil spring fitted on an outer side of the rotary shaft.

5. The cordless blind apparatus of claim 1, wherein the first rotary shaft has threads on the outer side to be a male screw, and the first rotary block has female threads on an inner side of a hole formed through a center thereof to be a female screw that is thread-fastened to the male screw.

6. The cordless blind apparatus of claim 1, wherein the friction member is an elastic body that elastically deforms between the first rotary shaft and the first rotary block and a thickness or an area of the friction member changes in the longitudinal direction of the first rotary shaft.

7. The cordless blind apparatus of claim 1, wherein the rotary shaft includes a second rotary shaft extending in the roller, and further includes a second rotary block fitted on the roller to rotate with the roller, and the elastic member is fixed to the second rotary block and the second rotary shaft at ends of the elastic member.

8. The cordless blind apparatus of claim 1, wherein the roller comprises a plurality of rollers arranged in parallel with each other, and the screen comprises a plurality of screens, the weight comprises a plurality of weights, and the elastic member comprises a plurality of elastic members that are provided to correspond to the rollers.

9. The cordless blind apparatus of claim 8, further comprising a connection hook disposed at least between the screens or between the weights, and the friction member is disposed on at least one of the rollers.

10. The cordless blind apparatus of claim 9, wherein the connection hook is slidably fitted in guide grooves formed on the weights.

11. A cordless blind apparatus comprising:

a roller that is fitted on a rotary shaft;

a screen that is wound or unwound on the roller;

a weight that is connected to a lower end of the screen and applies torque in a first direction in which the screen is unwound from the roller by gravity;

an elastic member that applies torque in a second direction in which the screen is wound, by applying elastic force to the roller; and a friction stopper assembly that generates friction force on the roller, wherein the rotary shaft includes a first rotary shaft extending in the roller, and the friction stopper assembly includes a first rotary block coupled to the roller to rotate with the roller and generate friction on the first rotary shaft, wherein the apparatus further comprises a friction member that is disposed on at least one of an outer side of the first rotary shaft and an inner side of the first rotary block to increase friction resistance, wherein the friction member has serrations on a surface being in contact with the first rotary block or a surface being in contact with the first rotary shaft, and wherein at least one of a height, a gap, and a shape of the serrations on the friction member changes in a longitudinal direction of the first rotary shaft, and wherein the friction member is configured to be removably attached to the first rotary shaft during assembly.

* * * * *